US009153128B2

(12) United States Patent
Holzwanger et al.

(10) Patent No.: US 9,153,128 B2
(45) Date of Patent: Oct. 6, 2015

(54) TRAFFIC SIGNAL DEVICE FOR DRIVER/PEDESTRIAN/CYCLIST ADVISORY MESSAGE SCREEN AT SIGNALIZED INTERSECTIONS

(71) Applicants: Mark Holzwanger, Forest Hills, NY (US); John Mackey, Lindenhurst, NY (US); Xianghong Henry Liu, Eagan, MN (US); Steven Cohen, New Rochelle, NY (US); Harry Holzwanger, Bayside, NY (US); Randall Guensler, Atlanta, GA (US)

(72) Inventors: Mark Holzwanger, Forest Hills, NY (US); John Mackey, Lindenhurst, NY (US); Xianghong Henry Liu, Eagan, MN (US); Steven Cohen, New Rochelle, NY (US); Harry Holzwanger, Bayside, NY (US); Randall Guensler, Atlanta, GA (US)

(73) Assignee: Holzmac LLC, New Rochelle, NY (US)

( * ) Notice: Subject to any disclaimer, the term of this patent is extended or adjusted under 35 U.S.C. 154(b) by 0 days.

(21) Appl. No.: 14/184,424

(22) Filed: Feb. 19, 2014

(65) Prior Publication Data

US 2015/0154860 A1 Jun. 4, 2015

Related U.S. Application Data

(60) Provisional application No. 61/767,201, filed on Feb. 20, 2013.

(51) Int. Cl.

| | |
|---|---|
| ***G08G 1/005*** | (2006.01) |
| ***G08G 1/096*** | (2006.01) |
| ***G08G 1/0967*** | (2006.01) |

(52) U.S. Cl.
CPC ..... *G08G 1/005* (2013.01); *G08G 1/096* (2013.01); *G08G 1/0967* (2013.01)

(58) Field of Classification Search
CPC ..... G08G 1/0967; G08G 1/133
USPC ..... 340/905, 907, 928, 929, 944
See application file for complete search history.

(56) References Cited

U.S. PATENT DOCUMENTS

| | | | | |
|---|---|---|---|---|
| 5,150,116 | A * | 9/1992 | West | 340/928 |
| 6,266,589 | B1 * | 7/2001 | Boies et al. | 701/36 |
| 8,232,896 | B2 | 7/2012 | Keller | |
| 8,675,909 | B2 * | 3/2014 | Sivertsen | 382/100 |
| 2002/0140604 | A1 * | 10/2002 | Doi | 342/385 |
| 2003/0020633 | A1 * | 1/2003 | Lee | 340/907 |
| 2005/0116838 | A1 * | 6/2005 | Bachelder et al. | 340/937 |
| 2005/0156757 | A1 * | 7/2005 | Garner | 340/907 |
| 2005/0200500 | A1 * | 9/2005 | Wing | 340/907 |
| 2006/0176192 | A1 * | 8/2006 | Noriega | 340/907 |
| 2007/0008178 | A1 * | 1/2007 | Lo | 340/907 |
| 2008/0104871 | A1 * | 5/2008 | Stadjuhar | 40/584 |

* cited by examiner

*Primary Examiner* — Benjamin C Lee
*Assistant Examiner* — Stephen Burgdorf
(74) *Attorney, Agent, or Firm* — Thomas I. Rozsa

(57) ABSTRACT

An encrypted traffic signal device controller (TSDC) and an Electronic Variable Message Sign (EVMS) at intersection roadways and related traffic intersections where the invention system is installed at traffic light intersections which will be triggered at the red light sequence where vehicles/pedestrian/cyclists are stopped. After the traffic light turns red, the time delay of the red light will trigger an audio and visual public announcement which will be of assistance to the driver and enable the driver to pay attention to the announcement without being concerned about diverting the driver's attention from driving the vehicle since the vehicle is stopped at a red light and the driver can devote his attention to reading the information provided.

9 Claims, 6 Drawing Sheets

TSDC SYSTEM: Features: traffic signal sequence counter, traffic flow sensor, announcements/advertising for EVMS and PAMS, wireless signal, data retriever.
TSDC receives the following information from data retriever, government agencies, traffic conditions, Amber alerts, public emergencies, private sector advertising
TSDC transmits collected data to EVMS and PAMS

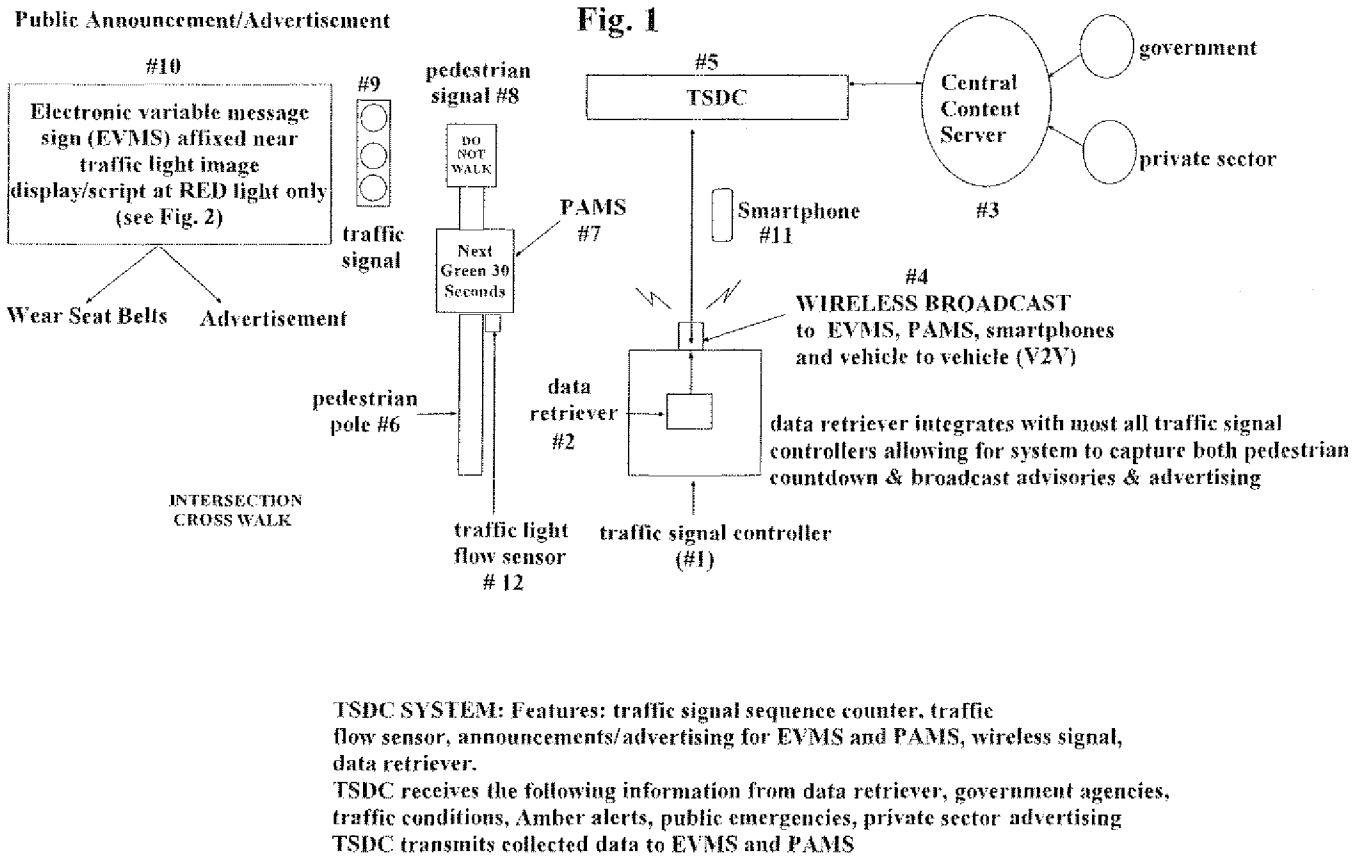

Fig. 1

TSDC SYSTEM: Features: traffic signal sequence counter, traffic flow sensor, announcements/advertising for EVMS and PAMS, wireless signal, data retriever.
TSDC receives the following information from data retriever, government agencies, traffic conditions, Amber alerts, public emergencies, private sector advertising
TSDC transmits collected data to EVMS and PAMS Intersection diagram of broadcast of the PAMS

TRAFFIC SIGNAL DEVICE FOR DRIVER/PEDESTRIAN/CYCLIST ADVISORY MESSAGE SCREEN AT SIGNALIZED INTERSECTIONS

This patent application claims priority to Provisional Application No. 61/767,201 filed on Feb. 20, 2013, now pending.

BACKGROUND OF THE INVENTION

1. Field of the Invention

The present invention relates to the field of advising traffic at an intersection so that cars can safely be stopped during a red light at the intersection and at the same time providing sufficient security for oncoming traffic that has not yet reached the intersection where the red light has occurred. The present invention also relates to the field of providing advertisements and information to drivers while the red light is on and their vehicle has stopped. The present invention relates to the field of providing traffic advisory messages to drivers/pedestrians/cyclists while the red light is on and the "DO NOT WALK" signal is on so that drivers/pedestrians/cyclist can be better informed with traffic conditions. The present invention also relates to the field of providing public announcements, emergency announcements and similar public safety messages for the driver/pedestrian/cyclist public, along with advertisements so that such systems can be self-funded, enabling Smartphones, or similar devices, that recognize these same messages and/or advertising via application (app) through such device (i.e., Smartphone) will also benefit from the broadcasting of the collected data from the encrypted traffic signal device.

2. Description of the Prior Art

Traffic control systems have certainly existed in the past, but to the best of the present inventors' knowledge, there is no traffic control system where the driver is stopped at a red light and provided with information concerning traffic, accidents and other public announcements. In addition, there is no pedestrian traffic control system for pedestrians/cyclists stopped at a red light and at pedestrian "DO NOT WALK" signals and provided with information concerning traffic, accidents, emergency alerts, public announcements, advertising and at the same time enabling other equipment, such as Smartphones, to have the same messages on its applications, nor is there any traffic control system with a pedestrian count down to the next pedestrian green light (i.e., the "WALK" sign). There is one particular prior art, U.S. Pat. No. 8,232,896. This invention claims a traditional pedestrian signal housing with a video display screen mounted to a pedestrian side of the traditional pedestrian signal housing is disclosed. This invention claims a video display screen is mounted to the pedestrian side of the pedestrian signal housing by way of a face plate. This invention claims tunnel visors may be attached to the traditional pedestrian signal housing to prevent cross traffic from being distracted by the visual images displayed on the video display screen. This invention claims the information displayed on the video display screen may be advertisements, information, directions, etc. Local or national entities may pay for advertisements to generate revenues for the cities or governmental entities. The invention is not considered an extension of this prior art because this invention does not provide for any type of countdown to the next green signal and there is no mention of any direct access to the traffic signal controller cabinet by this claim. The invention also has a method for data capturing of the traffic signal controller's information that includes, but not limited to, traffic signal sequences and live data traffic flow. In addition, the invention provides broadcasted information, advisories, advertisements, digital coupons, and similar communications to Smartphones or similar devices while within the traffic signal intersection area via blue tooth or similar communication protocols.

There is a significant need for such an invention to overcome the problems associated with not being able to inform drivers/pedestrians/cyclists about traffic conditions, traffic signal information, traffic accidents and other problems on the road, highway or at the neighborhood level having the traffic control intersection at a time period when they are stopped at a red light and pedestrian "DO NOT WALK" signal and so they do not need to be concerned about having their attention diverted from driving or intersection crossing. There is also a significant need to better inform pedestrians of best route through controlled intersections.

SUMMARY OF THE INVENTION

The present invention includes an encrypted traffic signal device controller (TSDC) and an Electronic Variable Message Sign (EVMS) at intersection roadways and related traffic intersections where the present invention system is installed at traffic light intersections which will be triggered at the red light sequence where vehicles/pedestrian/cyclists are stopped. After the traffic light turns red, the time delay of the red light will trigger an audio and visual public announcement which will be of assistance to the driver and enable the driver to pay attention to the announcement without being concerned about diverting the driver's attention from driving the vehicle since the vehicle is stopped at a red light and the driver can devote his attention to reading the information provided. A similar procedure also applies to pedestrians and cyclists where cyclists are on the road or at a sidewalk and pedestrians are at a sidewalk adjacent the operating traffic signal.

For purposes of this invention, vehicle means any vehicle driven by an individual on a roadway such as a car, truck, large tractor, trailer truck and any other vehicle having at least four wheels, and also including two wheeled vehicles, motorized two wheel vehicles including motorcycles. Cyclists include anyone riding a non-motorized two wheel vehicle such as a bicycle, mountain bicycle, racing bicycle etc. A pedestrian is any person who is crossing crosswalk including a person who is handicapped in some way and is using an assistant to travel across the intersection.

The positioning of the EVMS will be at the same eye - level as the traffic signal and near the traffic signal. The EVMS has a Doppler device and other current and future speed sensory detection devices that will detect rogue vehicle(s) that have been detected traveling in excess of the acceptable speed limit (i.e., slow down to stop speeds). This detection will prevent the EVMS to display the advisory messages so as to avoid distraction of said vehiele(s) to perform a stop approach. The invention also provides for the EVMS full color monitor screen to duplicate the exact traffic light sequence and therefore reinforces for approaching drivers the traffic light lens color displayed during the current light sequence (i.e. a driver in a car, is following a tractor trailer that is approaching a signalized intersection, has his/her field of view of the traffic signal blocked by said tractor trailer but is able to see the EVMS full color monitor screen which mirrors the signalized intersection's red light preventing a potential crash event).

The present invention also includes an encrypted pedestrian advisory message screen (PAMS) that is installed at signalized intersections which is affixed to the pedestrian signal pole or near to the pedestrian pole and can provide the waiting time for the next "WALK" phase for pedestrians along with advertisements, public announcements, emergency announcements and similar public safety messages for the pedestrians. After the "DO NOT WALK" phase starts, the waiting time for the next "WALK" phase will be displayed on PAMS until the next "WALK" phase starts which will eliminate distraction.

Another key innovation of the present invention is its ability to broadcast live data traffic flow and traffic signal sequences from the data retriever at the signalized intersection and therefore, the present invention will also provide for vehicular safety and to assist in easing roadway congestion.

It is therefore an overall object of the present invention to facilitate safety at the intersection where there is cross traffic.

It is a further object of the present invention to provide information to a driver/pedestrian/cyclist at an intersection, which information is transmitted at a safe time when the driver is stopped at a red light and the pedestrian and the cyclist are stopped at the "DO NOT WALK" signal.

Overall, it is an object of the present invention to enhance the safety of driving/walking/cycling when entering an intersection so as to avoid a crash, to provide vital information to drivers/pedestrians/cyclists at a time when they are able to read or hear the information because the vehicle/pedestrian/cyclist are stopped at a red light and pedestrian "DO NOT WALK" signal and to provide necessary emergency information at the same time.

In summary, the present invention is an encrypted traffic signal device controller at intersection roadways and related traffic intersections where the present invention system is installed at traffic light intersections which will be triggered at the red light sequence and the pedestrian "DO NOT WALK" signal where drivers/pedestrians/cyclists are stopped. The present invention includes a pedestrian advisory message screen (PAMS) ruggedized that is installed at traffic signalized intersections preferably affixed on or near the pedestrian signal pole above the pedestrian push button area preferably below the pedestrian signal and can provide the waiting time for the next "WALK" phase for pedestrians. After the "DON'T WALK" phase starts, the waiting time (countdown to next green light via a dedicated data retrieval unit installed within the traffic signal controller cabinet) for the next "WALK" phase will display visual and audio advisories, public announcements and advertisement can be displayed on PAMS until the next "WALK" phase starts. The present invention also includes an EVMS that is installed at signalized intersections near the traffic signal light and can provide useful traffic information to drivers at intersections where the present invention system's TSDC will be installed at traffic signal intersections with the dedicated data retrieval unit which is installed in traffic signal controller cabinets and will capture the red light sequence. After the traffic light turns red, there will be a time delay of the red light sequence. Immediately after the EVMS will trigger a visual and/or audio public announcement and other advisory messages which will be of assistance to the driver and enable the driver to pay attention to the announcement(s) without being concerned about diverting his/her attention since the vehicle is stopped at a red light and the driver can devote his/her attention to reading the information provided.

Overall, it is an object of the present invention to facilitate safety at intersections and to facilitate the transmission of information to individuals at intersections in a safe manner.

Further novel features and other objects of the present invention will become apparent from the following detailed description and discussion.

BRIEF DESCRIPTION OF THE DRAWINGS

Referring particularly to the drawings for the purpose of illustration only and not limitation, there is illustrated:

FIG. 1 is a schematic diagram of the present invention encrypted traffic signal device controller which provides information to a driver while stopped at a red light, which information includes information about traffic, accidents, public announcements and at the same time, enables the driver to obtain information of oncoming traffic and further enables the driver to devote attention to the information without being concerned about diverting attention from the driver because the driver has stopped at a red light and is not engaged in the driving activity. In addition, FIG. 1 includes a schematic diagram of the present invention of an encrypted pedestrian signal countdown to the next green light sequence which includes advisory and advertisement information. It further enables the pedestrian/cyclist to devote attention to the information without being concerned about diverting attention from the pedestrian/cyclist because the pedestrian/cyclist has stopped at a "DO NOT WALK" signal and is not engaged in the walking/cycling activity;

DETAILED DESCRIPTION OF EMBODIMENTS

Figure 2:
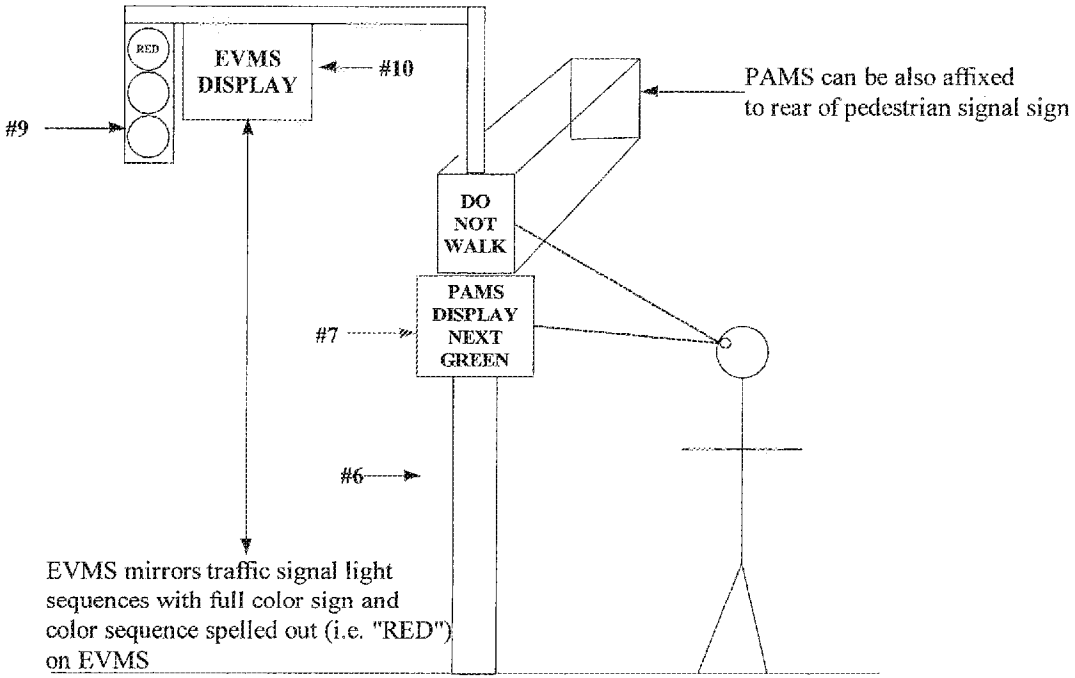
FIG. 2 is a visual image of a traffic signal light with the EVMS and a PAMS with a countdown to the next green light with advisory and advertising messages used in accordance with the present invention.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Defined broadly, the present invention is a method for advising traffic at an intersection comprising: (a) means for capturing traffic light signal sequences and broadcasting the information within the radius of the selected intersection; (b) means for delivering audio and video messages to drivers and/or cyclists who are stopped at a red light and pedestrians on a sidewalk within visual range of the "DO NOT WALK" signal to advise drivers/pedestrians/cyclists of conditions on the road, sidewalks and other important information which drivers/pedestrians/cyclists are able to read because they are not occupied with driving/walking/cycling due to the fact that they are stopped at a red light and pedestrian "DO NOT WALK" signal.

Described in more detail, the present invention is a method for advising traffic at an intersection comprising: (a) a means for delivering audio and video messages to drivers/pedestrians/cyclists who are stopped at a traffic signal with at least one red light and pedestrian "DO NOT WALK" signal operating with drivers driving a vehicle on a road leading to the red light, cyclists on either a road leading to the red light or at a sidewalk at an intersection adjacent the red light, and pedestrians at a sidewalk at an intersection where at least one red light is operating, to advise drivers/pedestrians/cyclists of driving/walking/cycling conditions on the road and sidewalk and transmitting additional information which drivers/pedestrians/cyclists are able to read because they are not occupied with driving/walking/cycling due to the fact that they are stopped at a red light and pedestrian "DO NOT WALK" signal; (b) means for delivering audio and video messages to pedestrians/cyclist who are stopped at a red light and pedestrian "DO NOT WALK" signal to advise pedestrians/cyclists of the waiting times for the next "WALK" phase along with advisory messages and advertisement; and (c) means for enabling apparatus selected from the group consisting of Smartphones, cellular phones, mobile phones, portable computers, tablets and communication technology devices that can receive wireless or similar communication protocol so that drivers/pedestrians/cyclists will be able to receive the same broadcasted information, advisories, public announcements, emergency alerts, advertisement from the means for delivering audio and video messages.

With respect to element "a" set forth above on the means for delivering audio and video messages, and also element "b" on the means for delivering audio and video messages, that is set forth in detail in the description below of FIGS. 1-6 and in particular, FIGS. 1 and 6.

With respect to element "c" set forth above, that is also disclosed in the description of FIG. 1 with the wording below starting after "traffic light turns red" and is also supported in FIGS. 2-6.

The present invention is also defined as a means for delivering live traffic flow data at an intersection where there is a traffic signal comprising: (a) the means for delivering live traffic flow data at the intersection where there is a traffic signal includes a proprietary data retrieval unit which is installed inside of a traffic signal controller cabinet located at the traffic signal intersection, which data retrieval unit also transmits via electronic variable message sign and pedestrian advisory message screen triggers; (b) the means for delivering the traffic flow data further includes a roadside loop detector hardwired to the traffic signal controller with information obtained stored within a data retrieval unit; and (c) a means for enabling the captured live traffic flow data to be broadcast motorists via at least wireless communications.

Claims 2 and 3 are also supported in FIGS. 1-6 and the description below.

Referring to FIG. 1, the present invention embodies use of existing traffic signal controllers (#1) already installed at intersections throughout the United States. A data retriever device (#2) is installed within the traffic controller (#1) and collects the traffic signal timing sequences. The data retriever integrates with most all traffic signal controllers allowing for the system to capture both pedestrian countdown and broadcast advisories and advertising. The traffic signal timing sequence data is transmitted to the TSDC (#5). The traffic signal data controller ("TSDC") feature the following functionalities: (i) traffic signal sequence counter, traffic flow sensor, announcements/advertising for EVMS (Electronic Variable Message Sign) and PAMS (Pedestrian Advisory Message Screen), wireless signal, and data retriever; (ii) TSDC receives the following information from the data receiver, government agencies, traffic conditions, Amber alerts, public emergencies, private sector advertising; (iii) TSDC transmits collected data to EVMS and PAMs. The TSDC (#5) collects the data from the central content server (#3) which is a computer specially programmed to perform the functions as set forth herein. At the precise time selected for images to be displayed, the system broadcasts (#4) to instruct the EVMS (#10) and the PAMS (#7) to display images/script to the viewer. The Electronic Variable Message Sign (EVNS) is affixed near traffic light image display/script at red light only. I may include advisory messages such as a warning to wear seat belts and various advertisements from various sponsors. The PAMS is typically next to green and will play for a given period of time such as thirty seconds. Both the EVMS (#10) and the PAMS (#7) will only be turned on during the red light traffic signal (#9) and the pedestrian "DO NOT WALK" signal (#8) sequences. The EVMS (#10) and PAMS (#7) will be turned on seconds after the red light sequence and the pedestrian "DO NOT WALK" signal is on. At this point, the EVMS (#10) and PAMS (#7) will turn off seconds before the red light and the pedestrian "DO NOT WALK" signal sequence ends. This is done in order for the driver/pedestrian/cyclist to orientate themselves for safety reasons. In addition, there will be at the end of the display, sequence safety reminders before proceeding with the green light and "WALK" signal sequence. As the information at the traffic signal intersection is being broadcasted, Smartphone (#11) will also benefit from the broadcasted information along with equipment embedded into vehicles. Affixed to the pedestrian signal pole (#6) is a traffic light flow sensor (#12) powered by the PAMS (#7) which aids in determining the volume of traffic within the selected intersections.

After a traffic light turns red and after the pedestrian "DO NOT WALK" signal is on, a time delay of the red light will trigger the audio; and the time of day will also trigger a visual public announcement selected from the group consisting of national, regional and local traffic, weather, amber and other emergency alerts and notices, and in addition television station program spots to provide the alert on major channel stations such as CBS, NBC, ABC and various cable television networks, along with advertisement from any business that may purchase time during the red light sequence (collectively "images"). Toward the end of the red light sequence (cycle) and the pedestrian "DO NOT WALK" signal, the images and audio switches off terminating any distraction to the driver/pedestrian/cyclist. The TSDC will interact with the driver's communication platform (hand held device selected from the group consisting of smart phones, cellular phones, mobile phones, portable computers, tablets and any other new communication technology that can receive blue tooth, Wi fi and similar wireless communication technology, vehicle OEM (Original Equipment Manufacturer) or after-market blue tooth systems (#3) via a software application on the aforementioned devices.

This application will be also available for all passengers and pedestrians emanating from the traffic light system within the blue tooth radius of the TSDC (#5). An additional application of the present invention is to facilitate vehicles in motion having the capacity to receive and transmit image/script data outside the vehicle and inside the vehicle from any traffic signal device that has the present invention technology at a selected traffic signal.

The central content server (#3) will be dedicated to the national emergency broadcast system, insurance companies, federal, state and local governments. These claims will alert the driving public who utilize the present invention system of government announcements and advertisements.

The PAMS (#7) is integrated with the red light sequence (cycle). The present invention system TSDC (#5) incorporates the use of existing Doppler and any current and future vehicle sensor technology with the formula of a calculated volume, time, distance and speed. When the red light cycle is on, the system will detect the volume, time, distance and speed of opposing intersecting vehicular traffic flow. The traffic flow sensor application (#12) will improve emissions and gas consumption by reducing vehicle waiting time at the red traffic light signal and provide safer approaches to the intersection.

Referring to FIG. 2, the present invention embodies a traffic signal (#9) light supported by a traffic signal pole (#6). The EVMS (#10) is also supported by the same traffic signal pole and is at the same eye level as the traffic signal closest to the red light signal lens so as to have the driver with the same line of sight of viewing the traffic light signal. In addition, the EVMS (#10) will mirror the traffic signal light colors with a full solid color screen reflecting same traffic light signal lens color being emanated during the respective color signal sequence. Affixed to the pedestrian signal pole is the PAMS (#7) which will be at an eye level of an adult. The EVMS mirrors traffic signal light sequences with full color sign and color sequences spelled out (i.e. "RED") on EVMS.

Figure 3:
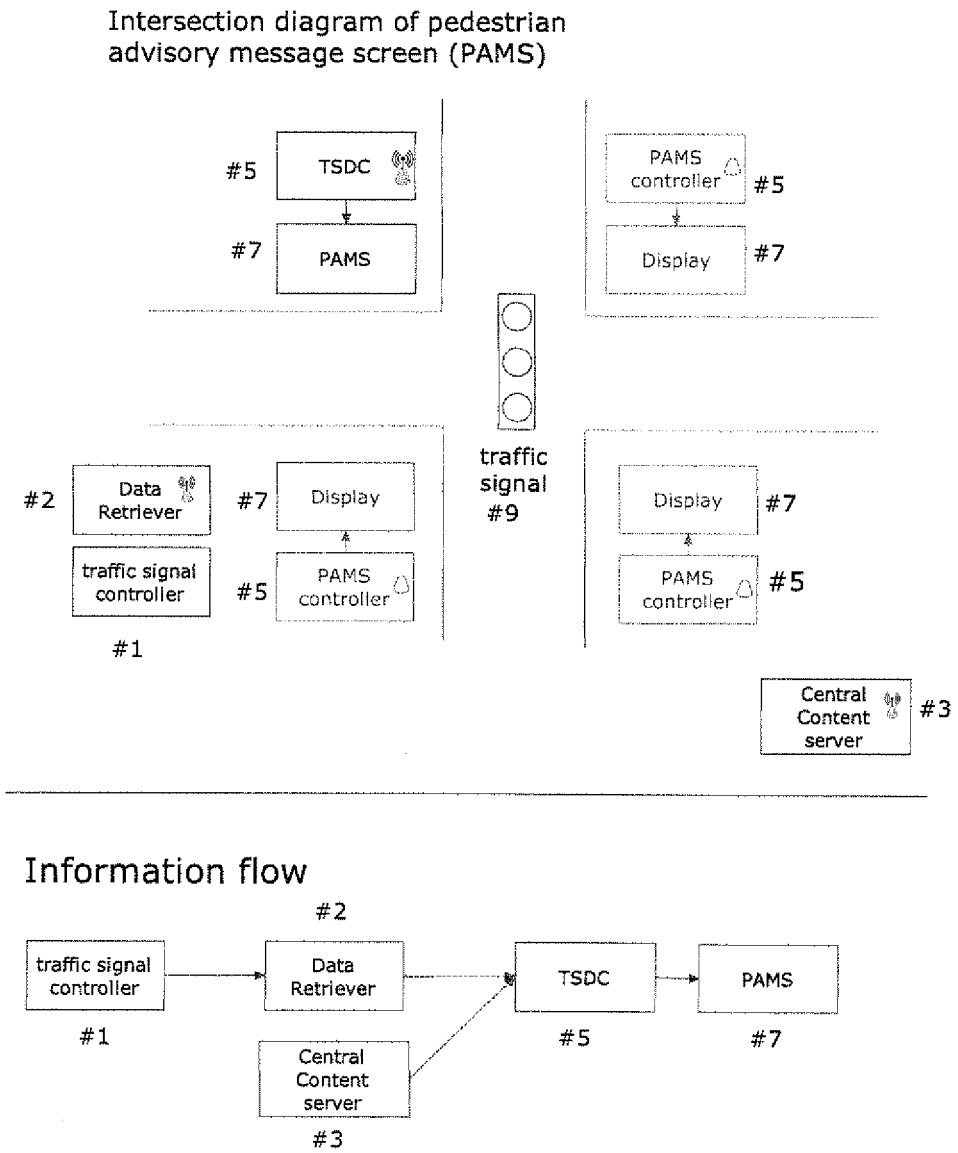
FIG. 3 is a visual image of a traffic signal intersection with placement of PAMS and the TSDC at the four corners of an intersection used in accordance with the present invention.

Referring to FIG. 3, the present invention embodies a traffic signal (#9) intersection diagram of the PAMS (#7) depicting each corner of an intersection with dedicated TSDC (#5) and the individual PAMS (#7). Each intersection has a dedicated data retriever (#2) and a central content server (#3). Depicted is the already existing traffic signal controller (#1) for the traffic signal intersection. The information flow in the figure begins with the traffic signal controller (#1) wherein the data retriever (#2) secures the traffic signal sequences with the central content server (#3) providing the information that the invention will display through the TSCD (#5). The end process is that the TSCD will determine the time and the type of preprogrammed display (#7) on the EVMS and the PAMS.

Figure 4:
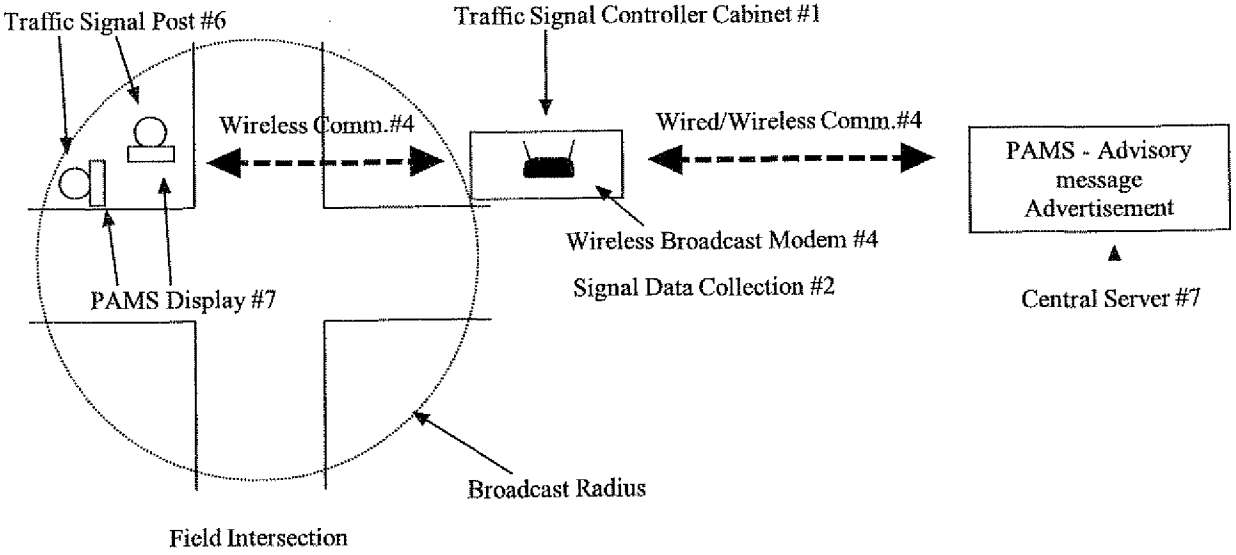
FIG. 4 is a visual image of a traffic signal intersection depicting the broadcast process of the PAMS used in accordance with the present invention.

Referring to FIG. 4, the present invention embodies traffic signal intersection with wireless communications (#4) broadcasting the central content server's (#3) information from the TSDC (#5) to the PAMS (#7). The information as to the specific broadcast radius is within a specific designated distance such as one block of the traffic signal. As illustrated in FIG. 4, the traffic signal controller cabinet (#1) includes a wireless broadcast modem (#4) in addition to the signal data collection apparatus (#2). The wireless communication clearly goes from the broadcast to send the information to the PAMS advisory message and advertisement (#7) which is adjacent each traffic signal as depicted at the intersection in FIG. 4.

Figure 5:
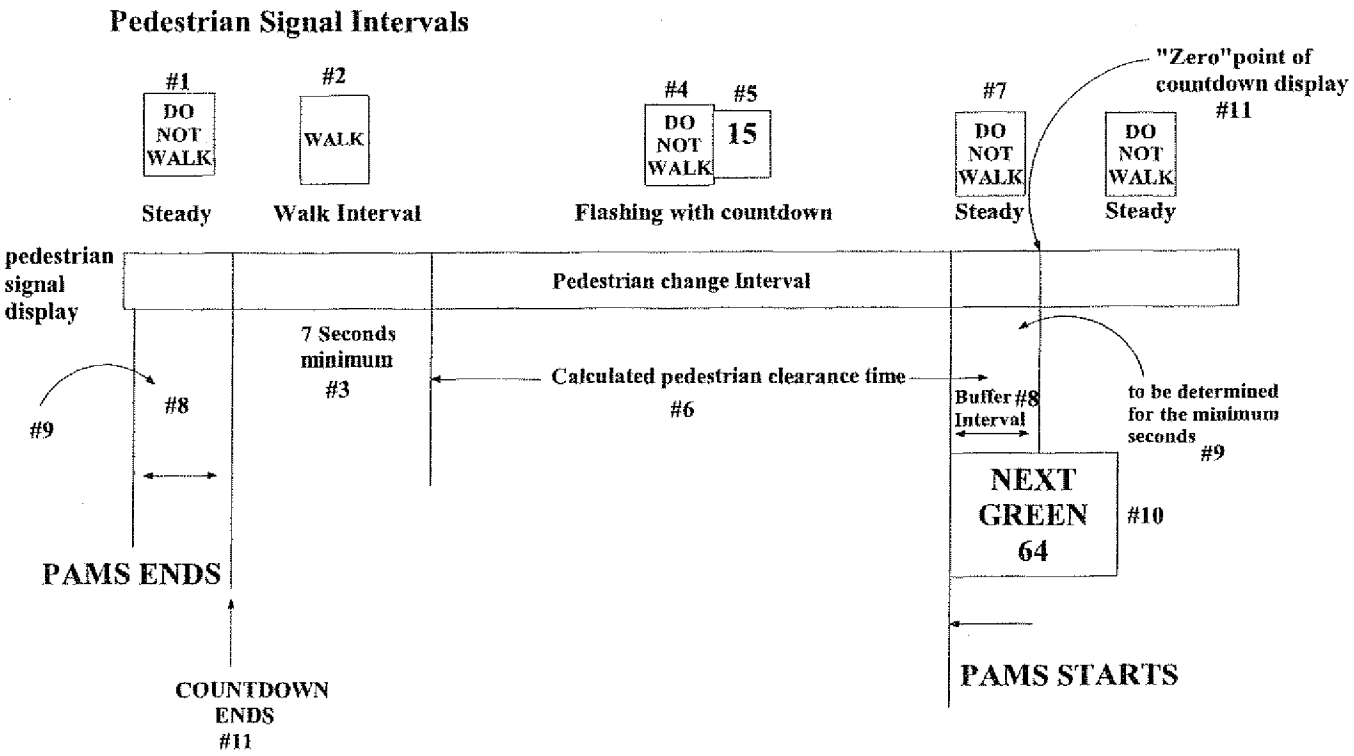
FIG. 5 is a schematic diagram of the pedestrian signal interval phase during the "DO NOT WALK" signal to the "WALK" signal phase and the return to the "DO NOT WALK" signal phase. The diagram depicts the ability of the pedestrian/cyclist to obtain information and to devote attention to the information without being concerned about diverting attention from the pedestrian/cyclist because the pedestrian/cyclist has stopped at a pedestrian "DO NOT WALK" and is not engaged in the walking/cycling activity.

Referring to FIG. 5, the present invention embodies an example of pedestrian signal intervals. The pedestrian "DO NOT WALK" signal (#1) is Steady until the "WALK" (#2) interval time frame and calculates to be determined in seconds (i.e. 7 seconds) (#3) until the Flashing countdown commences (#4). The countdown (i.e. 15 seconds) (#15) is the pedestrian clearance time to reach the other side of the intersection's crosswalk. The interval at the "DO NOT WALK" provides for a buffer interval (#8) which is the time needed for the pedestrian to orientate to the "DO NOT WALK" phase of the pedestrian signal interval (i.e. 3 seconds). The buffer interval (#8) minimum time is to be determined with testing (#9) before the zero point of countdown display (#11). The next pedestrian signal interval is at the end of the "DO NOT WALK" signal phase (#1) with the end of the traffic signal sequence with a buffer interval (#8) minimum time is to be determined with testing (#9) with the PAMS ending at the beginning of the buffer interval (#8). The system ends when the next green 64 (#10) is lit and then when it turns to red, the pedestrian signal interval begins again as illustrated in FIG. 5 and as discussed above.

Figure 6:
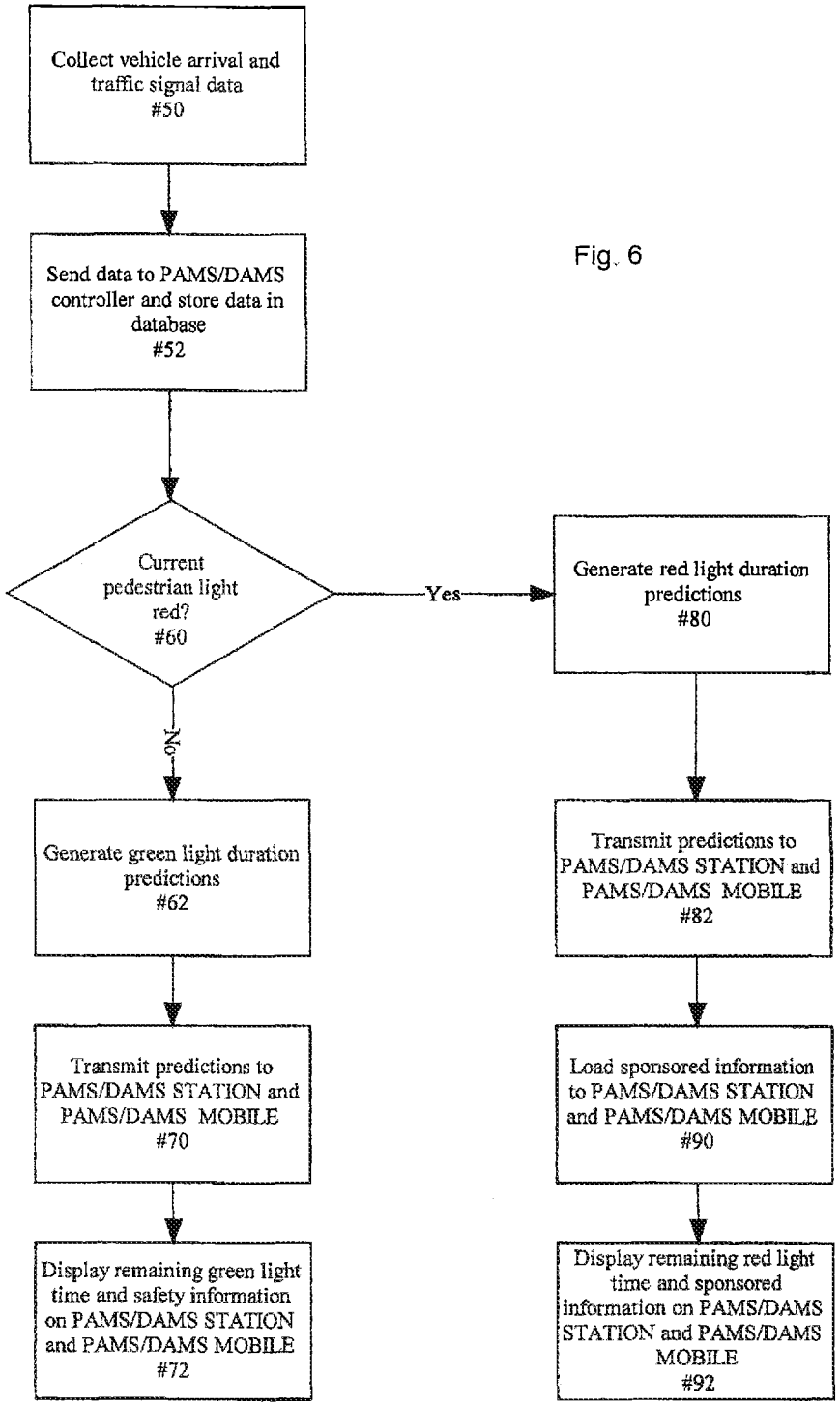
FIG. 6 is a schematic diagram of how EVMS/PAMS collects, sends, generates, transmits and displays during red light signal and green light signal durations.

Referring to FIG. 6, there is illustrated a schematic diagram of how EVMS/PAMS collected, sends, generates, transmits and displays during red light signal and green light signal durations. As set forth in the block diagram, the first step is to collect vehicle arrival and traffic signal data (#50). After that, the next step is to send data to EVMS/PAMS controller and store data in a database (#52). At that point, it comes to a decision tree which requires a decision to be made which is numbered 60. The question asked is: is the light red? If the light is red, then one course of action takes place. If the light is not red (green), then a second decision path takes place. For one path, if the light is not red and is green, then the program generates a green light duration prediction number 62 (#62). The idea is as discussed above to have a suspension of the present invention while the light is green so as not to interfere with the attention of anyone driving a vehicle or walking across a crosswalk or riding a bicycle or other two wheeled vehicle such as a motorcycle. The next step if in fact the light is green is to transmit predictions to the EVMS/PAMS station and EVMS/PAMS mobile 70 (#70). Thereafter, the system displays remaining green light time and safety information on EVMS/PAMS station and EVMS/mobile station 72. Therefore, the system is in suspension until the light turns red. Going back to the decision tree at 60 ((#60), if the light is red, then the system generates the red light duration predictions 80 (480). The system then transmits predictions to EVMS/PAMS station and EVMS/PAMS mobile 82 (#82). The system then loads the sponsored information to EVMS/PAMS station and EVMS/PAMS mobile for any paid advertisements or any other information to be transmitted which is not a public service, but is a paid advertisement 90 (#90).

Finally, the system displays remaining red light time and sponsored information on EVMS/PAMS station and EVMS/PAMS mobile number 90 (#90). It is noted that the display on EVMS and PAMS also deals with all of the information previously set forth in the previous discussion and in the description of the preferred embodiment and reference to the drawings as set forth in the brief description of the drawings and in the detailed description of embodiments.

There is a need to provide motorist, who are color blind and have color disorientation, with distinguishable properly displayed traffic signal sequences due to their physical challenge to see proper colors at the traffic signal light intersections. The Federal Highway Administration's (FHWA) Manual Unifo in Traffic Control Device (MUTCD) regulations makes mention of the particularly difficulty of motorist who have color blindness or color disorientation with making a distinction between red and green. The FHWA has been addressing this issue since the "1930s". Their explanation to remedy this issue is to keep standard color red on top of color yellow and color yellow on top of color green in the traffic signal light lenses. The invention's EVMS, as was previously mentioned in the invention's previous claim, will be in a full color mode during the respective traffic signal light color sequence and will have will have the color spelled out within in the screen of the respective light color sequence. For example, when the traffic sight light turns red, the EVMS will minor the same full color screen red as the traffic signal light. The screen will spell out the color being displayed (i.e. "RED") at the same time the color sequence has been displayed to the motorist. The invention will assist the motorist with color disorientation and color blindness of the proper traffic signal light sequence and other motorists who may require additional reinforcement of the traffic signal light sequence.

Insofar as the description above and the accompanying drawing disclose any additional subject matter that is not within the scope of the single claim below, the inventions are not dedicated to the public and the right to the one or more applications to claim such additional inventions is reserved.

The inventors have all jointly contributed to the invention as described in the patent application. While certain claims have been set forth in the present application, it is anticipated that the applicants may file amendments to these claims or additional claims of invention before the patent application is examined or reserve the right to file divisional applications as fully supported by the patent specification to present additional claims if necessary.

Of course the present invention is not intended to be restricted to any particular form or arrangement, or any specific embodiment, or any specific use disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A system located at a traffic light intersection having a pedestrian signal displaying at different periods of time at least a WALK sign and a DON'T WALK sign, the pedestrian signal affixed to a pole, a traffic signal displaying at different periods of time at least a red light and a green light, the traffic signal affixed to a support structure, and a traffic signal controller within a traffic signal controller cabinet, and used in conjunction with a group selected from a vehicle driver, a pedestrian and a cyclist respectively arriving at, stopping at and departing from the traffic light intersection, the system comprising:

a. a pedestrian advisory message screen (PAMS) displaying encrypted advisory information selected from the group consisting of advertisements, public announcements, emergency announcements, and a visual countdown to display the amount of time remaining before the next pedestrian WALK sign is illuminated (individually and collectively referred to as advisory PAMS information), the advisory PAMS information is displayed only when the pedestrian DON'T WALK sign is illuminated, the pedestrian advisory message screen is affixed to the pole onto which the pedestrian signal is affixed;

b. an electronic variable message screen (EVMS) displaying encrypted advisory information selected from the group consisting of advertisements, public announcements, emergency announcements, and a visual countdown to display the amount of time remaining before the next green light is illuminated (individually and collectively referred to as advisory EVMS information), the advisory EVMS information is displayed only when the red light on traffic signal is illuminated, the electronic variable message screen is affixed the support structure onto which the traffic signal is affixed;

c. a signal data retriever device integrated with the traffic signal controller, both the signal data retriever device and the traffic signal controller retained in the traffic signal controller cabinet, the signal data retriever device captures a real-time status of when the WALK sign is illuminated and when the DON'T WALK sign is illuminated at the pedestrian signal and when the red light is illuminated and when the green light is illuminated at the traffic signal from the traffic signal controller;

d. a central content server collects (i) alternative information data in text form and images form from the group consisting of: government agencies, traffic conditions at the traffic light intersection and traffic conditional at locations at distances away from the traffic light intersection, amber alerts, public emergencies and private sector alerts and (ii) alternative information image content from the group consisting of: government agencies, traffic conditions at traffic light intersections and traffic conditional at locations at distances away from the traffic light intersections, amber alerts, public emergencies, private sector alerts;

both alternative information data in text form and alternative information image content (referred to as central content server data), is wirelessly transmitted to traffic signal data controller (TSDC), the TSDC encrypts the central content server data and then wirelessly transmits the encrypted central content server data to the pedestrian advisory message screen and to the electronic variable message screen as advisory PAMS information and advisory EVMS information;

e. the pedestrian advisory message screen is turned on for a PAMS activation period beginning after a time delay after the pedestrian DON'T WALK sign is illuminated and ending before the pedestrian WALK sign is illuminated, and the pedestrian advisory message screen is turned off before the pedestrian WALK sign is illuminated and the pedestrian advisory message screen remains blank until after the time delay after the pedestrian DON'T WALK sign is illuminated, the pedestrian advisory message screen displaying the advisory PAMS information during the PAMS activation period;

f. the electronic variable message screen is turned on for an EVMS activation period beginning after a time delay after the red light on the traffic signal is illuminated and ending before the green light on the traffic signal is illuminated, and the electronic variable message screen is turned off before the green light on the traffic signal is illuminated and the electronic variable message screen remains blank until after the time delay after the red light on the traffic signal is illuminated, the electronic variable message screen displaying the advisory EVMS information during the EVMS activation period;

g. the pedestrian advisory message screen, the electronic variable message screen, and the signal data retriever device are all in separate locations to provide advisory information and are independent of any traffic control system; and h. the electronic variable message sign at the traffic light intersection includes a Doppler device which functions as a speed detector to detect a vehicle traveling at excess speed so that the vehicle cannot come to a full stop when the vehicle approaches the traffic light intersection and the Doppler device prevents the electronic variable message sign from displaying the advisory EVMS information so that drivers in other vehicles will not be distracted by the advisory EVMS information and can avoid a crash with the vehicle traveling at excess speed.

2. The system located at a traffic light intersection in accordance with claim 1, further comprising: the signal data retriever device installed within the traffic signal controller cabinet and integrated with the traffic signal data controller wirelessly enables the traffic signal data controller to send advisory information selected from the group consisting of encrypted advisory PAMS information and encrypted advisory EVMS information to a portable electronic device selected from the group consisting of smart phones, cellular phones, mobile phones, portable computers, tablets, a WiFi receiving device and a blue tooth receiving device having a compatible software application in the portable electronic device.

3. The system located at a traffic light intersection in accordance with claim 1, further comprising:

a. the advisory PAMS information is selected from the group consisting of encrypted visual information displayed on the pedestrian advisory message screen and encrypted audio information from an acoustic transmission member incorporated with the pedestrian advisory message screen;

b. the advisory EVMS information is selected from the group consisting of encrypted visual information displayed on the electronic variable message screen and encrypted audio information from an acoustic transmission member incorporated with the electronic variable message screen; and c. the collected server data is selected from the group consisting of encrypted visual information displayed on the pedestrian advisory message screen, and encrypted audio information from an acoustic transmission member incorporated with the pedestrian advisory message screen, encrypted visual information displayed on the electronic variable message screen and encrypted audio information from an acoustic transmission member incorporated with the electronic variable message screen.

4. The system located at a traffic light intersection in accordance with claim 1, further comprising: the advisory PAMS information is selected from the group consisting of encrypted visual information displayed on the pedestrian advisory message screen and encrypted audio information from an acoustic transmission member incorporated with the pedestrian advisory message screen.

5. The system located at a traffic light intersection in accordance with claim 1, further comprising: the advisory EVMS information is selected from the group consisting of encrypted visual information displayed on the electronic variable message screen and encrypted audio information from an acoustic transmission member incorporated with the electronic variable message screen.

6. A system located at a traffic light intersection having a pedestrian signal displaying at different periods of time at least a WALK sign and a DON'T WALK sign, the pedestrian signal affixed to a support structure, a traffic signal displaying at different periods of time at least a red light and a green light, the traffic signal affixed to a support structure, and a traffic signal controller within a traffic signal controller cabinet, and used in conjunction with a group selected from a vehicle driver, a pedestrian and a cyclist respectively arriving at, stopping at and departing from the traffic light intersection, the system comprising:

a. a pedestrian advisory message screen (PAMS) displaying advisory information selected from the group consisting of advertisements, public announcements, emergency announcements, and a visual countdown to display the amount of time remaining before the next pedestrian WALK sign is illuminated (individually and collectively referred to as advisory PAMS information), the advisory PAMS information is displayed only when the pedestrian DON'T WALK sign is illuminated, the pedestrian advisory message screen is affixed to a structure at a location which enables a WALK or DON'T WALK image and the pedestrian advisory message screen to be simultaneously seen;

b. an electronic variable message screen (EVMS) displaying advisory information selected from the group consisting of advertisements, public announcements, emergency announcements, and a visual countdown to display the amount of time remaining before the next green light is illuminated (individually and collectively referred to as advisory EVMS information), the advisory EVMS information is displayed only when the red light on the traffic signal is illuminated, the electronic variable message screen is affixed to a support structure which enables an un-blocked red light or green and the electronic variable message screen to be simultaneously seen;

c. a signal data retriever device integrated with the traffic signal controller, both the signal data retriever device and the traffic signal controller retained in the traffic signal controller cabinet, the signal data retriever device captures a real-time status of when the WALK sign is illuminated and when the DON'T WALK sign is illuminated at the pedestrian signal and when the red light is illuminated and when the green light is illuminated at the traffic signal from the traffic signal controller, d. a central content server collects (i) alternative information date in text form from the group consisting of: government agencies, traffic conditions at the traffic light intersection and traffic conditional at locations at distances away from the traffic light intersection, amber alerts, public emergencies and emergencies, private sector alerts and (ii) alternative information image content from the group consisting of: government agencies, traffic conditions at traffic light intersections and traffic conditional at locations at distances away from the traffic light intersections, amber alerts, public emergencies, private sector alerts;

both alternative information data in text form and alternative information image content (referred to as central content server data), is wirelessly transmitted to a traffic signal data controller (TSDC), the TSDC encrypted central content server data and then wirelessly transmits the encrypted central content server data to the pedestrian advisory message screen and to the electronic variable message screen as advisory PAMS information and advisory EVMS information;

e. the pedestrian advisory message screen is turned on for a PAMS activation period beginning after a time delay after the pedestrian DON'T WALK sign is illuminated and ending before the pedestrian WALK sign is illuminated, and the pedestrian advisory message screen is turned off before the pedestrian WALK sign is illuminated and the pedestrian advisory message screen remains blank until after the time delay after the pedestrian DON'T WALK sign is illuminated, the pedestrian advisory message screen displaying the advisory PAMS information during the PAMS activation period;

f. the electronic variable message screen is turned on for an EVMS activation period beginning after a time delay after the red light on the traffic signal is illuminated and ending before the green light on the traffic signal is illuminated, and the electronic variable message screen is turned off before the green light on the traffic signal is illuminated and the electronic variable message screen remains blank until after the time delay after the red light on the traffic signal is illuminated, the electronic variable message screen displaying the advisory EVMS information during the EVMS activation period;

g. the pedestrian advisory message screen, the electronic variable message screen, and the signal data retriever device are all independent of any traffic control system; and h. the electronic variable message sign at the traffic light intersection includes a Doppler device which functions as a speed detector to detect a vehicle traveling at excess speed so that the vehicle cannot come to a full stop when the vehicle approaches the traffic light intersection and the Doppler device prevents the electronic variable message sign from displaying the advisory EVMS information so that drivers in other vehicles will not be distracted by the advisory EVMS information and can avoid a crash with the vehicle traveling at excess speed; and i. the signal data retriever device installed within the traffic signal controller cabinet and integrated with the traffic signal data controller wirelessly enables the traffic signal data controller to send advisory information selected from the group consisting advisory PAMS information and advisory EVMS information to a portable electronic device selected from the group consisting of smart phones, cellular phones, mobile phones, portable computers, tablets, a WiFi receiving device and a blue tooth receiving device having a compatible software application in the portable electronic device.

7. The system located at a traffic light intersection in accordance with claim 6, further comprising:

a. the advisory PAMS information is selected from the group consisting of visual information displayed on the pedestrian advisory message screen and audio information from an acoustic transmission member incorporated with the pedestrian advisory message screen;

b. the advisory EVMS information is selected from the group consisting of visual information displayed on the electronic variable message screen and audio information from an acoustic transmission member incorporated with the electronic variable message screen; and c. the collected server data is selected from the group consisting of visual information displayed on the pedestrian advisory message screen, and audio information from an acoustic transmission member incorporated with the pedestrian advisory message screen, visual information displayed on the electronic variable message screen and audio information from an acoustic transmission member incorporated with the electronic variable message screen.

8. The system located at a traffic light intersection in accordance with claim 6, further comprising: the advisory PAMS information is selected from the group consisting of visual information displayed on the pedestrian advisory message screen and audio information from an acoustic transmission member incorporated with the pedestrian advisory message screen.

9. The system located at a traffic light intersection in accordance with claim 6, further comprising: the advisory EVMS information is selected from the group consisting of visual information displayed on the electronic variable message screen and audio information from an acoustic transmission member incorporated with the electronic variable message screen.

* * * * *